US007909103B2

(12) United States Patent
Fenton

(10) Patent No.: US 7,909,103 B2
(45) Date of Patent: Mar. 22, 2011

(54) RETRIEVABLE TUBING HANGER INSTALLED BELOW TREE

(75) Inventor: Stephen P. Fenton, Balmedie (GB)

(73) Assignee: VetcoGray Inc., Houston, TX (US)

( * ) Notice: Subject to any disclaimer, the term of this patent is extended or adjusted under 35 U.S.C. 154(b) by 1006 days.

(21) Appl. No.: 11/737,487

(22) Filed: Apr. 19, 2007

(65) Prior Publication Data

US 2007/0246220 A1 Oct. 25, 2007

Related U.S. Application Data

(60) Provisional application No. 60/793,467, filed on Apr. 20, 2006.

(51) Int. Cl.
*E21B 29/12* (2006.01)
*E21B 7/12* (2006.01)

(52) U.S. Cl. ..... 166/348; 166/368; 166/381; 166/97.1; 166/75.13; 166/347

(58) Field of Classification Search ..... 166/368, 166/348, 360, 341, 343, 339, 338, 347, 381, 166/386, 75.13, 95.1, 97.1, 88.4, 89.1
See application file for complete search history.

(56) References Cited

U.S. PATENT DOCUMENTS

| | | | | |
|---|---|---|---|---|
| 3,724,501 | A * | 4/1973 | Scott | 137/630.19 |
| 4,651,831 | A * | 3/1987 | Baugh | 166/344 |
| 5,372,199 | A | 12/1994 | Cegielski et al. | |
| 5,971,077 | A | 10/1999 | Lilley | |
| 6,053,252 | A * | 4/2000 | Edwards | 166/348 |
| 6,227,301 | B1 * | 5/2001 | Edwards et al. | 166/344 |
| 6,293,345 | B1 * | 9/2001 | Watkins | 166/368 |
| 6,302,212 | B1 * | 10/2001 | Nobileau | 166/368 |
| 6,460,621 | B2 | 10/2002 | Fenton et al. | |
| 6,470,968 | B1 | 10/2002 | Turner | |
| 6,675,900 | B2 | 1/2004 | Baskett et al. | |
| 6,763,891 | B2 * | 7/2004 | Humphrey et al. | 166/368 |
| 6,810,954 | B2 | 11/2004 | Garrett et al. | |
| 6,823,941 | B2 * | 11/2004 | Donald | 166/368 |
| 7,013,970 | B2 * | 3/2006 | Collie et al. | 166/89.1 |
| 7,025,132 | B2 * | 4/2006 | Kent et al. | 166/87.1 |
| 7,032,673 | B2 * | 4/2006 | Dezen et al. | 166/341 |
| 7,093,660 | B2 * | 8/2006 | Hopper et al. | 166/348 |
| 7,201,229 | B2 * | 4/2007 | White et al. | 166/368 |
| 2002/0100592 | A1 * | 8/2002 | Garrett et al. | 166/378 |
| 2003/0051878 | A1 * | 3/2003 | DeBerry | 166/348 |
| 2003/0111228 | A1 | 6/2003 | Garrett | |
| 2004/0163818 | A1 * | 8/2004 | Fenton et al. | 166/368 |
| 2005/0109514 | A1 * | 5/2005 | White et al. | 166/368 |
| 2010/0006301 | A1 * | 1/2010 | Fenton | 166/368 |

FOREIGN PATENT DOCUMENTS

GB 2166775 A * 5/1986

(Continued)

*Primary Examiner* — Thomas A Beach
(74) *Attorney, Agent, or Firm* — Bracewell & Giuliani

(57) ABSTRACT

A subsea wellhead assembly has a tubing hanger landed in a wellhead housing. A spool lands on the wellhead housing and has a bore with a laterally extending production flow outlet. A tree cap having an axially extending flow passage and a laterally extending production flow outlet lands within the bore of the spool. Upper and lower seals on the tree cap seal between the tree cap and the bore of the spool above and below the production flow outlet of the spool. An isolation tube on a lower end of the tree cap sealingly engages the production flow passage of the tubing hanger. The tree cap may be ran with the spool as an assembly and retrieved from the spool for workover operations.

20 Claims, 4 Drawing Sheets

FOREIGN PATENT DOCUMENTS

| | | | |
|---|---|---|---|
| GB | 2361725 | A | 10/2001 |
| GB | 2397312 | A | 7/2004 |
| GB | 2352258 | A | 1/2007 |
| WO | WO 00/47864 | | 8/2000 |

* cited by examiner

RETRIEVABLE TUBING HANGER INSTALLED BELOW TREE

CROSS-REFERENCE TO RELATED APPLICATION

This application claims priority to provisional application 60/793,467, filed Apr. 20, 2006.

FIELD OF THE INVENTION

This invention relates generally to a subsea wellhead assemblies, and more particularly to a configuration with a tubing hanger landed in a subsea wellhead housing, a spool with a lateral flow outlet and control valves landed on the wellhead housing, and wherein the tubing hanger is retrievable without removing the spool.

BACKGROUND OF THE INVENTION

A subsea well typically has a wellhead housing located on the sea floor. One or more casing hangers are supported in the wellhead housing, each located at the upper end of a string of casing. In one type of wellhead assembly, a tubing hanger located at the upper end of a string of tubing is installed in the wellhead housing. The operator may perforate the well at that point and install a wire line plug in the production passage of the tubing hanger. The operator then lands a production tree on the wellhead housing, the tree having a number of valves for controlling the well fluid. The tree has a production flow passage and an isolation sub that stabs into the production passage of the tubing hanger. The operator then removes the wire line plug by lowering a tool through the production flow passage of the tree. For a workover operation involving pulling of the tubing hanger, the tree must be disconnected from the wellhead housing. If the tree needed to be retrieved for repair work, this can be done without pulling the tubing.

In another type of wellhead assembly, the tree is installed on the wellhead housing before running the tubing. The operator connects the drilling riser to the tree, lowers the tubing hanger through the drilling riser and lands the tubing hanger in the tree. The tubing hanger has a lateral flow outlet that registers with a lateral flow outlet in the tree. The operator installs a wire line plug in the tubing hanger vertical bore above the flow outlet. The tree does not need to be disconnected from the wellhead housing for pulling the tubing for a workover operation. If the tree needed to be retrieved for repair, the tubing would have to be pulled.

U.S. Pat. No. 5,372,199 discloses a configuration with a lower tubing hanger landed in the wellhead housing and supporting a string of tubing. A tree having a lateral flow outlet lands on the wellhead housing. An upper tubing hanger is landed in the bore of the tree. The upper tubing hanger has an isolation tube on its lower end that stabs into engagement with the production passage in the lower tubing hanger. The upper tubing hanger has a lateral flow outlet that registers with the lateral flow outlet of the tree. An internal tree cap is installed within the bore of the tree above the upper tubing hanger. The tubing can be pulled without disconnecting the tree from the wellhead housing by first retrieving the tree cap, then the upper tubing hanger, and then the lower tubing hanger and tubing. Similarly, the tree can be retrieved without pulling the tubing.

In the various configurations described above, the tree is a large, heavy and complex assembly that is run on a string of drill pipe. The running procedure requires a vessel with a derrick. It may not be economical to utilize the same vessel that drilled the well to complete the well and install the tree. Designs for trees that can be run on a lift line are known, but these systems typically do not have the ability to pull the tubing without disturbing the connection between the tree and the wellhead housing.

SUMMARY OF THE INVENTION

The wellhead assembly of this invention has a tubing hanger that lands in the wellhead housing and has features that enable the tubing to be pulled without disturbing the connection between the tree and the wellhead housing. A spool, which may be considered to be at least part of a production tree, lands on the wellhead housing. The spool has a bore and a laterally extending production flow outlet. A tree cap lands within the bore of the spool, the tree cap having an axially extending flow passage and a laterally extending a production flow outlet that aligns with the production flow outlet of the spool. Upper and lower seals on the tree cap seal between the tree cap and the bore of the spool above and below the production flow outlet of the spool. The upper seal is the uppermost pressure barrier in the bore of the spool. An isolation tube on a lower end of the tree cap sealingly engages the production flow passage of the tubing hanger.

In the first embodiment, the tubing hanger is installed and the well completed before running the spool. The tree cap is installed in the spool at the surface and the assembly is lowered together onto the wellhead housing. In the second embodiment, the operator installs the spool before drilling out through the wellhead housing. The drilling riser is coupled to the spool and the well is drilled to total depth through the spool. After reaching total depth, the operator runs the tubing through the spool and completes the well. Then the tree cap is installed.

In both embodiments, the tree cap may be retrieved from the spool for pulling the tubing through the tree for workover operations. Also, in the preferred embodiment, the tree cap has a flange that lands on the rim of the spool and a mandrel that protrudes above the spool. The mandrel has an external profile for attaching workover pressure control equipment to the tree cap.

DETAILED DESCRIPTION OF THE PREFERRED EMBODIMENT

Figure 1:
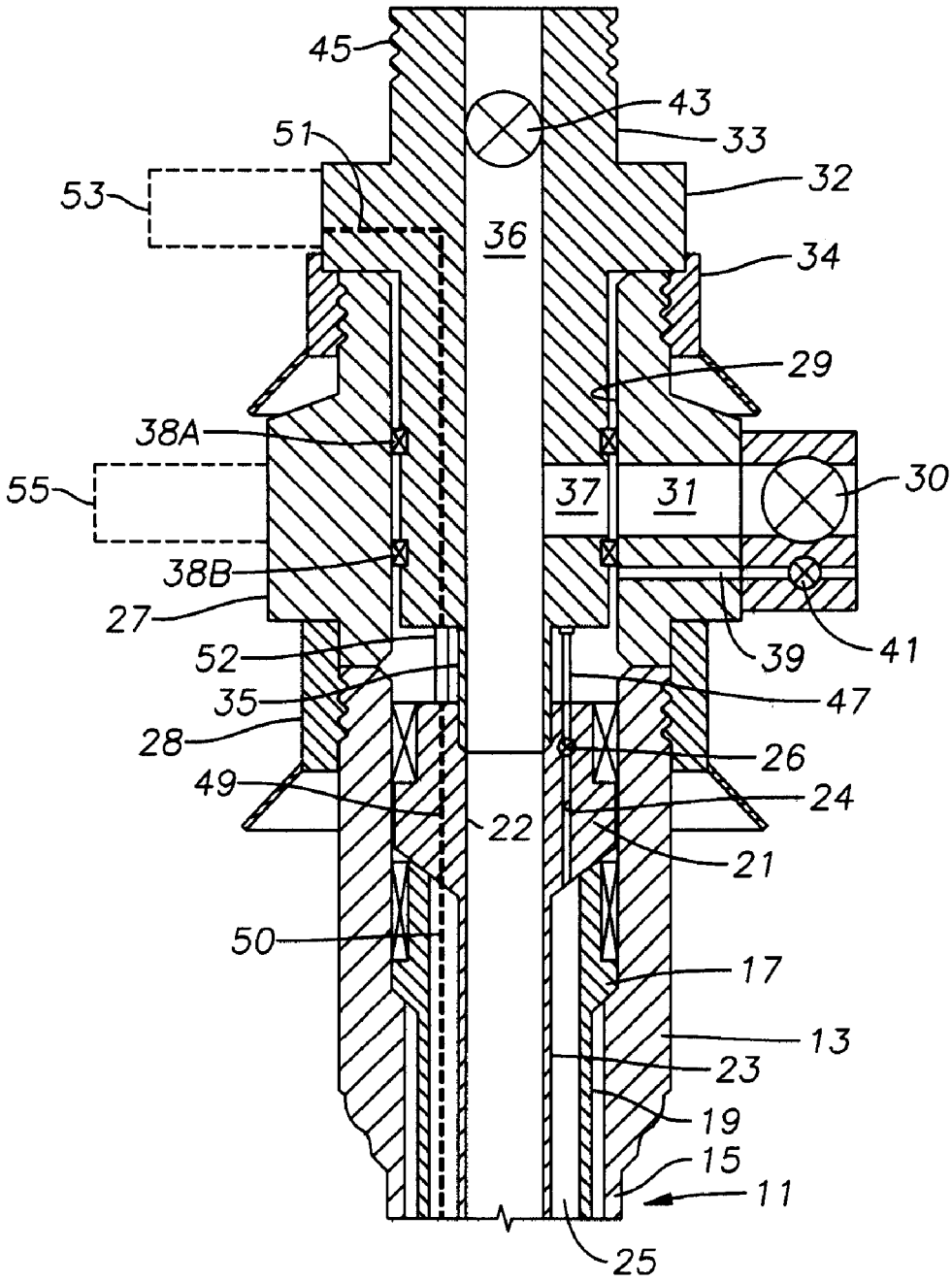
FIG. 1 is schematic sectional view of a subsea wellhead assembly constructed in accordance with the present invention.

FIG. 1 shows a completed subsea wellhead assembly in accordance with both methods. A subsea well 11 has a wellhead housing 13 with a conductor casing 15 extending therefrom to a predetermined depth within the subsea well. A casing hanger 17 is landed within wellhead housing 13 with a string of casing 19 extending therefrom to another predetermined depth within subsea well 11.

A tubing hanger 21 is landed within wellhead housing 13, with a string of tubing 23 extending therefrom within string of casing 19. In the preferred embodiment, tubing 23 extends to a production depth such that tubing 23 receives well fluid from within subsea well 11. Tubing hanger 21 has an axially extending production flow passage 22. A tubing annulus 25 is defined between the interior surface of string of casing 19 and the exterior surface of string of tubing 23, Tubing hanger 21 optionally may have a tubing annulus passage 24 extending axially through it offset from and parallel to production flow passage 22. In addition, a tubing annulus valve 26 may be located within tubing annulus passage 24 for opening and closing passage 24. In one embodiment, tubing annulus valve 26 is biased by a spring to a closed position. Tubing hanger 21 is rotated or oriented to a desired orientation relative to wellhead housing 13. Orientation may be accomplished in a variety of known ways.

A production tree or spool 27 lands on and connects to an upper end portion of wellhead housing 13 with an external connector 28, shown schematically. Spool 27 has a bore 29 extending axially therethrough that has a diameter at least equal to the diameter of tubing hanger 21 so that tubing hanger 21 can be retrieved through spool 27. Optionally, bore 29 may be as at least as large as the portion of the bore of wellhead housing 13 above casing hanger 17 to allow casing hanger 17 to be installed through spool 27 in accordance with the second method of this invention. Spool 27 has an outlet port 31 extending through a side wall of spool 27 for the flow of production fluids from tubing 23. At least one outlet valve 30 is mounted to the exterior of spool 27 to control the flow of well fluids exiting spool 27 through outlet port 31. Well fluids flowing through outlet valve 30 are delivered by methods known to those skilled in the art to a subsea collection manifold or to a platform located at the surface. Spool 27 will have additional equipment associated with subsea trees, such as cross-over piping and valves.

The subsea wellhead assembly also preferably includes a tree cap 33 having a lower cylindrical portion that is closely received within bore 29 of spool 27. Tree cap 33 may either connect to spool 27 internally or externally as shown. In this embodiment, tree cap 33 has an external flange 32 that lands on the rim or upper end of spool 27. An external connector 34 connects tree cap 33 to a profile formed on the upper portion of spool 27.

Tree cap 33 has an axially extending production passage 36. An isolation tube 35 is secured to the lower end of tree cap 33. Isolation tube 35 extends downward and stabs into sealing engagement with production passage 22 in tubing hanger 21 to receive well fluids from tubing 23. An outlet opening 37 extends laterally from production passage 36 through a sidewall of tree cap 33 to allow fluid flow to spool outlet port 31. Upper and lower seals 38A, 38B extend around tree cap 33 and sealing engage spool bore 29 above and below outlet port 31. In this embodiment, upper seal 38A is the uppermost pressure barrier that seals to bore 29.

A tubing annulus access port 39 extends through a sidewall of spool 27 below lower seal 38B for registering with and monitoring annulus 25. Tubing annulus access port 39 is in communication with spool bore 29 below lower seal 38B. A valve 41 is mounted to the exterior of tubing annulus access port 39 for opening and closing port 39.

Tree cap 33 has a valve 43 above lateral flow outlet 37 for opening and closing access to its production passage 36. If desired, a wire line plug profile could be formed in production passage 36 above flow outlet 37 for installing a wire line (or ROV tool installable) plug as a second pressure barrier within production passage 37. Tree cap 33 optionally has a cylindrical mandrel portion above its flange 32 that has a grooved profile 45 for coupling to pressure control equipment, such as a riser or blowout preventer, during wire line or similar workover operations. Tree cap 33 may have an actuator 47 extending downward from its lower end for engaging and opening tubing annulus valve 26. Actuator 47 could be a fixed probe that compresses the spring within tubing annulus valve 26 to cause it to open. Alternately, actuator 47 could be hydraulically extended and retracted.

In this embodiment, tubing hanger 21 has a number of auxiliary passages 49 (only one shown) extending from its lower end to its upper end. Auxiliary passages 49 are used to control downhole safety valves (not shown), to communicate with downhole sensors, and for other functions, such as supplying power to a downhole electrical submersible pump. Auxiliary passage 49 is shown schematically connected to a downhole auxiliary line 50 that extends alongside tubing 23 for supplying hydraulic fluid pressure or electrical or optical signals. Each auxiliary passage 49 has a coupling receptacle on the upper end of tubing hanger 21.

Preferably tree cap 33 has mating auxiliary passages 51 extending through it. A coupling 52 associated with each auxiliary passage 51 depends downward from tree cap 33 and stabs into sealing engagement with one of the auxiliary passages 49 in tubing hanger 21. In this embodiment, the upper ends of at least some of the tree cap auxiliary passages 51 extend to a side of tree cap 33 above spool 27. A controls module 53 having electrical and hydraulic control circuitry mounts to tree cap 33 for supplying hydraulic fluid pressure and electrical power to downhole safety valves and sensors. Controls module 53 may optionally be retrievable from tree cap 33 as well as retrievable along with tree cap 31 controls module 53 may also control tree cap valve 43, if one is utilized. A separate controls module 55 may be mounted to a side of spool 27 for controlling valves 30. If so, preferably controls module 55 is retrievable from spool 27.

Figure 2:
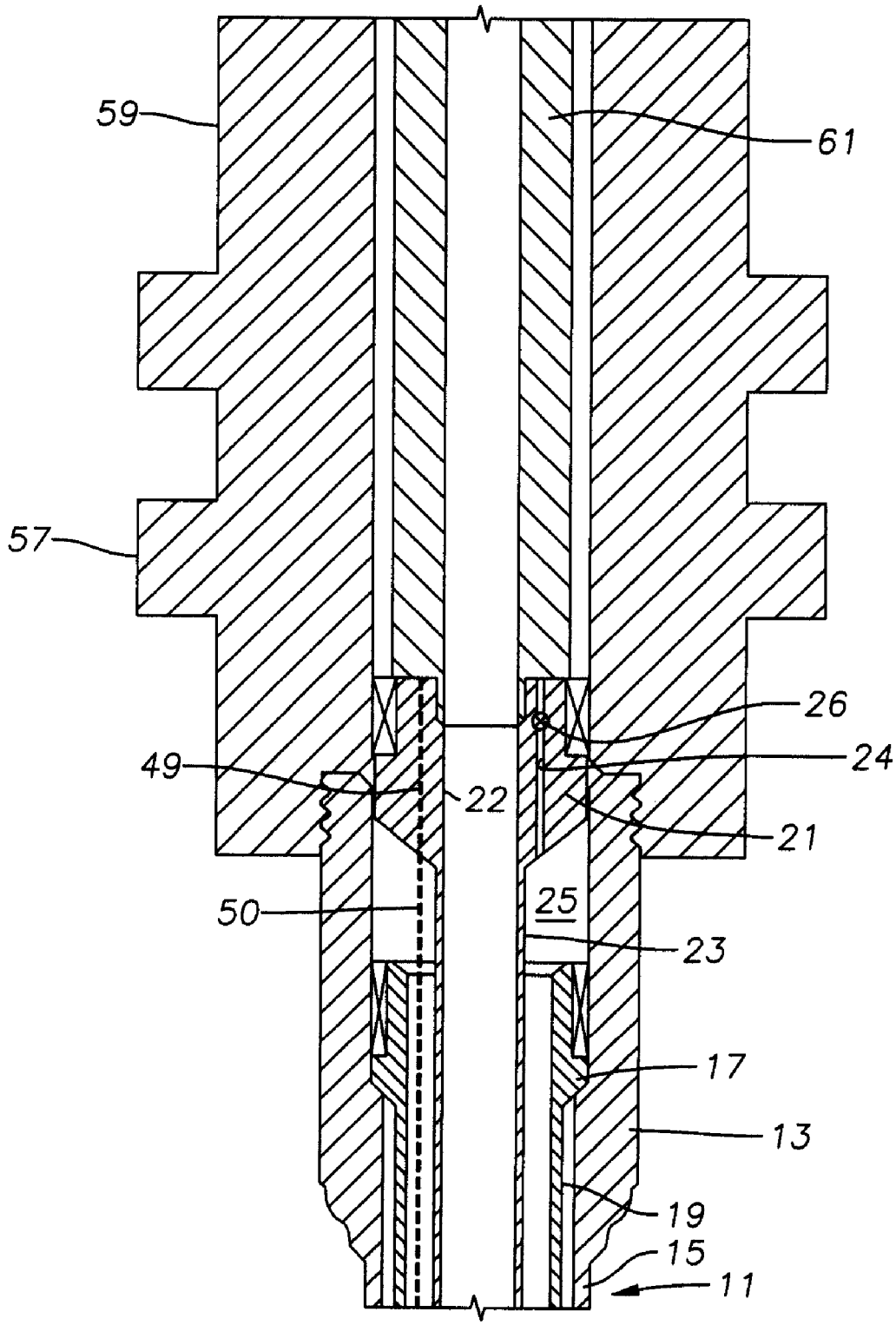
FIG. 2 is a schematic sectional view of the tubing hanger being installed in the subsea wellhead housing of FIG. 1 in accordance with a first method of the invention.

In the first method of operation, subsea wellhead housing 13 and conductor casing 15 are landed within subsea well 11. As shown in FIG. 2, a blowout preventer assembly ("BOP") 57 is attached to an upper end portion of wellhead housing 13. BOP 57 is a lower part of a string of drilling riser 59 that extends to a drilling vessel. Drilling operations are conventionally conducted through BOP 57 and wellhead housing 13. When at total depth, casing hanger 17 and string of casing 19 are lowered through drilling riser 59 and BOP 57, landed within wellhead housing 13 and cemented into place within the well in a manner known in the art. More than one string of casing may be installed.

Tubing hanger 21 and a string of tubing 23 are then lowered on a running tool 61 and drill string through drilling riser 59 and BOP 57. Tubing hanger 21 is oriented, landed, sealed, and latched conventionally in the bore of wellhead housing 13. For example, the orientation may be with a pin and slot arrangement associated with BOP 57, or a separate orientation spool might be employed. When tubing hanger 21 lands, tubing 23 will extend into the subsea well to a production depth. Normally, the operator will circulate the drilling mud from casing 19 by pumping down tubing annulus 25 and returning fluid up tubing 23, or vice-versa. Running tool 61 will open tubing annulus valve 26 and the downhole safety valve to allow circulation to occur. The operator may also perforate and test the well in a conventional manner at this point.

After perforating and testing the well, the operator lowers a temporary plug 63 (FIG. 3) on a wire line through the drill string and running tool 61 and latches it within production passage 22 of tubing hanger 21 to seal subsea well 11. The drilling riser and blowout preventer assembly 57, 59 are then removed from connection with wellhead housing 13. The drilling vessel may also leave the vicinity to drill another well. At this point, the operator can install additional equipment, such as piping on flow lines to a subsea manifold or the surface without BOP 57 and drilling riser 59 being in the way.

Figure 3:
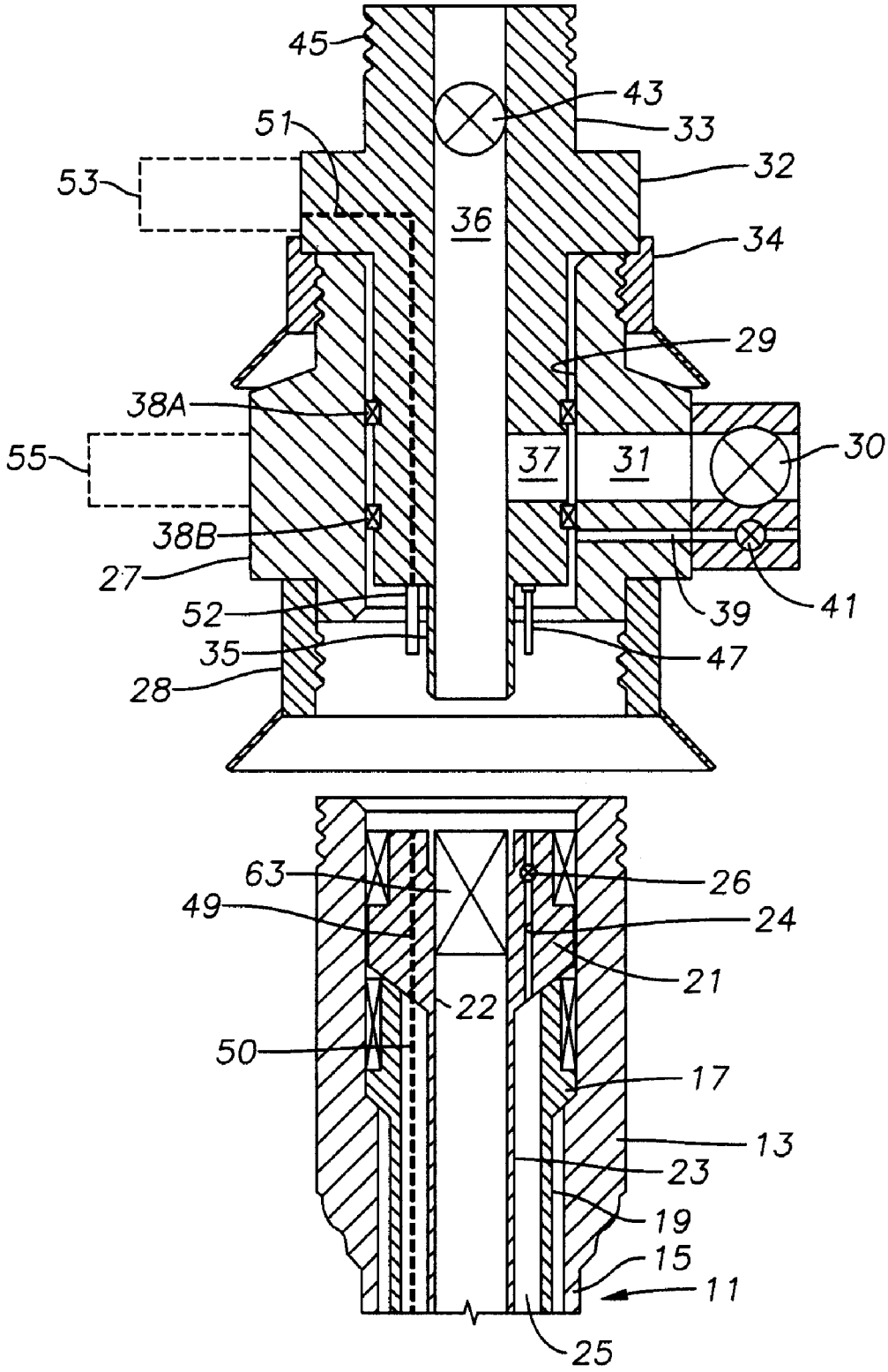
FIG. 3 is a schematic sectional view of the spool and tree cap being installed on the wellhead housing of FIG. 1 in accordance with the first method of the invention.

At the surface, the operator assembles tree cap 33 to spool 27 with the desired orientation. The operator subsequently lowers the pre-unitized assembly of tree cap 33 and spool 27, as illustrated in FIG. 3, preferably on a lift line. It is not necessary for the vessel used to lower the assembly to have a derrick or the capability of running drill pipe. The operator orients and lands flow spool 27 complete and pre-unitized with tree cap 33 on an upper end portion of wellhead housing 13. The orientation of spool 27 to wellhead housing 13 may be handled conventionally, such as with the assistance of an ROV (remote operated vehicle) and video cameras. Upon landing, isolation spool 35 stabs into engagement with production passage 22 of tubing hanger 21, thereby defining an axial passage extending from a production depth of subsea well 11 to outlet opening 37 of tree cap 33. Outlet opening 37 aligns with outlet port 31 so that well fluids can flow directly from outlet opening 37 through outlet port 31.

Also, upon landing of spool 27, auxiliary couplings 52 connect auxiliary lines 50 to control module 53. In addition, tubing annulus valve actuator 47 stabs into tubing annulus valve 26 and opens it, which places annulus access port 39 in fluid communication with tubing annulus 25. The operator plugs control modules 53, 55 into a subsea umbilical that delivers electrical and hydraulic power and control signals. The operator can then remove plug 63 through tree assembly 33 to initiate well fluid production from subsea well assembly 11. This may be handled with a subsea plug removal tool (such as shown in U.S. Pat. No. 6,719,059) that is lowered on a lift line and attached to tree cap profile 45 with the assistance of an ROV. Upon removing plug 63, the operator opens valve 30 to communicate well fluids from string of tubing 23 to a subsea manifold or to a collection facility located on a surface.

For workover operations through tubing 23, the operator may attach a riser to tree cap 33 and perform operations through tubing 23, such as wire line operations. For a workover operation requiring the retrieval of tubing 23, the operator can install wire line plug 63 back in tubing hanger 21 using a subsea plug retrieval tool, then retrieve tree cap 33 on a lift line. The operator would then attach a workover or drilling riser to spool 27 and pull tubing hanger 21 and tubing 23 in a conventional manner through the workover riser. Prior to pulling tubing hanger 21, the operator would typically render the well safe by "killing" in a routine manner. Well circulation would be in the same manner as during completion, which is via running tool 61, tubing annulus passage 24 in tubing hanger 21 and tubing 23.

If desired, the workover operation may include further drilling, such as drilling a sidetracked portion of the well to a more productive zone. In one method, after pulling tubing 23, the operator pulls casing hanger 17 along with production casing 19 through spool 27 and the workover or drilling riser. The operator would then lower a drill string through the riser and spool 27 and drill a sidetracked portion of the well. The operator would run casing or a liner through the riser and spool 27 into the sidetracked portion and install a string of tubing in the sidetracked portion. The operator would complete the sidetracked portion of the well in the same manner as described above.

Figure 4:
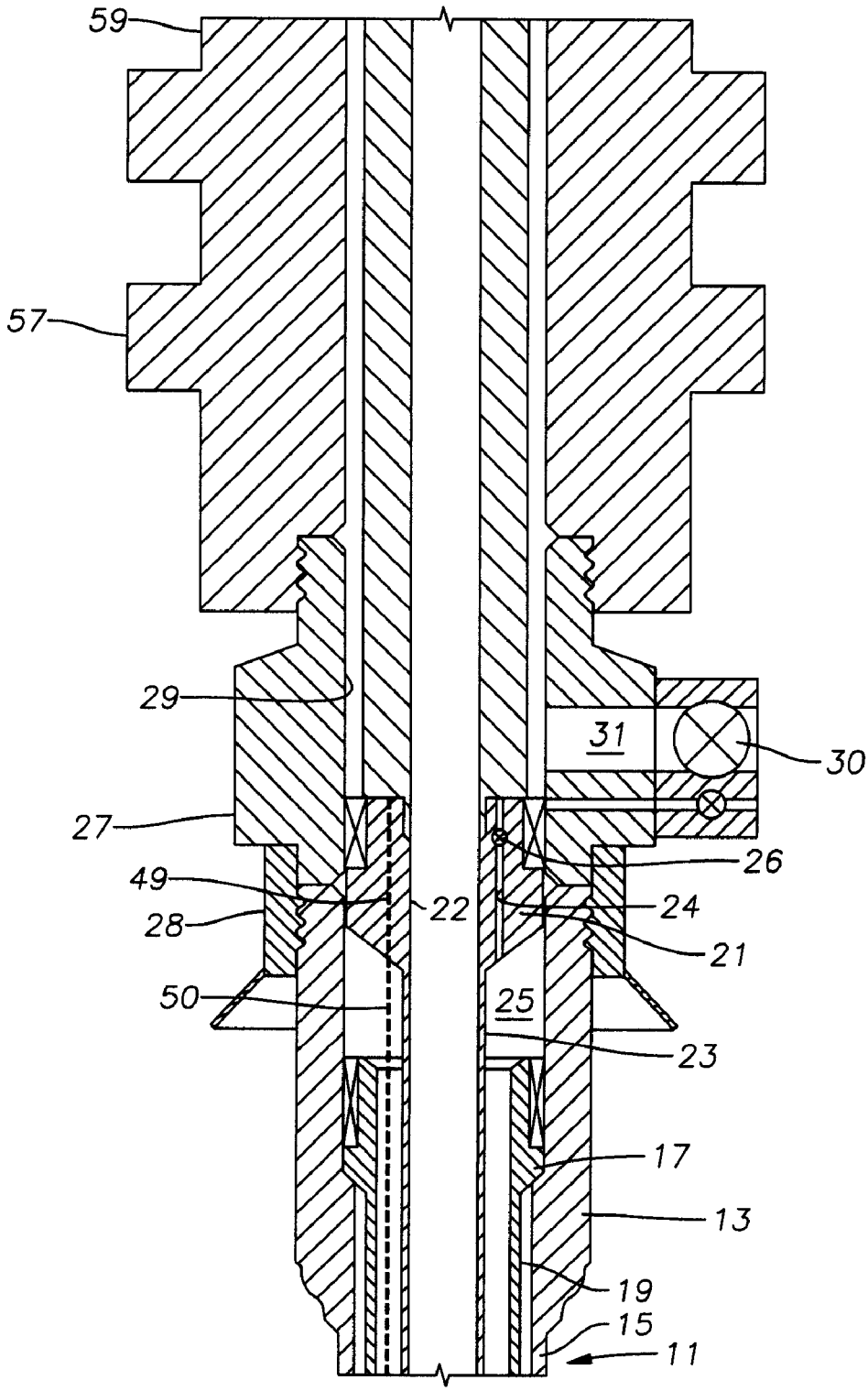
FIG. 4 is a schematic sectional view of the tubing hanger being lowered through the previously installed spool in accordance with a second method of the invention.

FIG. 4 illustrates an alternative embodiment, which involves drilling the well through spool 27. Wellhead housing 13 and conductor casing 15 are installed in a conventional manner as in the first method. After installing wellhead housing 13 and outer casing 15, the operator then orients, lands and connects spool 27 to an upper end portion of wellhead housing 13. Typically spool 27 is installed off via a lift line, but it could also be run on a drill string. The operator then lowers the drilling riser 59 and connects BOP 57 with the profile on an upper end portion of spool 27. The operator then continues drilling through BOP 57 and spool 27. Such an operation is also known as "drill through" operations.

Upon drilling subsea well 11 to a desired depth, operator then lowers casing hanger 17 with string of casing 19 attached thereto through drilling riser 59 and BOP 57 and lands, sets and seals casing hanger 17 within wellhead housing 13. The operator then lowers tubing 23 to the production depth of subsea well 11 and lands tubing hanger 21 in wellhead housing 13. The operator completes and tests the well in a conventional manner through the drilling riser and BOP 57. Using a wire line, the operator then lowers plug 63 (FIG. 2) through BOP 57 to sealingly close subsea well 11. The operator then removes drilling riser 59 and BOP 57.

The operator then lowers tree cap 33 via a lift line to land within spool 27. As before, isolation tube 35 is attached to tree cap 33 and stabs into sealing engagement with production passage 22 in tubing hanger 21. Tree cap auxiliary passages 51 mate with auxiliary passages 49 in tubing hanger 21. Upon landing tree cap 33 within spool 27, the operator can remove plug 63 from tubing hanger 21 to allow well fluids to flow from a lower end portion of string of tubing 23 to outlet opening 37. The operator then opens valve 30 to allow flow of well fluids from subsea well 11 to a subsea manifold collection manifold or to the surface.

The invention has significant advantages. In addition to serving as a pressure barrier, the tree cap provides a communication flow path for the production fluid from the tubing hanger to the production flow outlet in the spool. Completing the well before running the spool, as in the first embodiment, allows the drilling rig to be moved, if desired, before installing the spool. The spool and tree cap can be assembled as a unit and lowered on a lift line on a vessel that may lack a derrick. In the second embodiment, the well may be drilled to total depth and casing installed through the spool. In both embodiments, for workover operations requiring retrieval of tubing, the tree cap can be pulled without disturbing the spool. Auxiliary lines, such as for downhole sensors and safety valves, may be lead through the tree cap to the exterior of the tree cap above the spool. The control module associated with these functions may be mounted to the tree cap and retrievable along with the tree cap. The controls for the valves of the spool may be in a separate module, if desired, and attached to the spool. Landing the tree cap on the rim of the spool avoids the need for a landing shoulder within the bore of the spool.

While the invention has been shown in only one of its forms, it should be apparent to those skilled in the art that it is not so limited, but is susceptible to various changes without departing from the scope of the invention.

The invention claimed is:

1. A wellhead assembly, comprising:

a wellhead housing;

a tubing hanger having a production flow passage landed and sealed in the wellhead housing, the tubing hanger having an upper end recessed within the wellhead housing;

a spool landed on the wellhead housing and having a bore and a production flow outlet extending laterally through a side wall of the spool;

a tree cap landed within the bore of the spool, the tree cap having an axially extending flow passage and a production flow outlet leading from its production flow passage in fluid communication with the production flow outlet of the spool;

upper and lower seals on the tree cap that seal between the tree cap and the bore of the spool above and below the production flow outlet of the spool; and an isolation tube on a lower end of the tree cap that extends into the wellhead housing and sealingly engages the production flow passage of the tubing hanger.

2. The assembly according to claim 1, further comprising:

a tubing annulus port extending through the tubing hanger for communicating a tubing annulus below the tubing hanger with the bore of the wellhead housing above the tubing hanger;

a tubing annulus valve in the tubing annulus port in the tubing hanger, the tubing annulus valve being spring-biased toward a closed position; and an actuator on a lower end of the tree cap for engaging and opening the tubing annulus valve.

3. The assembly according to claim 1, wherein the tree cap has a mandrel that protrudes above the spool and has an external grooved profile for attaching workover pressure control equipment to the tree cap.

4. The assembly according to claim 1, the tree cap has an integral external flange that lands on a rim of the spool as the tree cap is inserted into the bore of the spool.

5. The assembly according to claim 1, further comprising an external connector mounted to and lowered with the tree cap onto the spool for connecting the tree cap to an external profile on the spool.

6. A wellhead assembly, comprising:

a wellhead housing having a bore;

a casing hanger landed in the bore of the wellhead housing for supporting a string of casing;

a tubing hanger landed in the bore of the wellhead housing above the casing hanger for supporting a string of tubing, the tubing hanger having a production flow passage extending therethrough, the tubing hanger having an upper portion that is sealed to the bore of the wellhead housing and an upper end that is recessed within the bore of the wellhead housing;

a tubing annulus port extending through the tubing hanger alongside the production flow passage for communicating a tubing annulus below the tubing hanger with the bore of the wellhead housing above the tubing hanger;

a spool supported by the wellhead housing, the spool having a bore and a production flow outlet leading through a sidewall of the spool from the bore, the bore of the spool being at least equal in diameter to the tubing hanger so as to allow running and retrieval of the tubing hanger through the spool;

a tree cap landed within the bore of the spool, the tree cap having an exterior portion containing upper and lower seals that seal the exterior portion of the tree cap to the bore of the spool above and below the production flow outlet of the spool, the tree cap having an axially extending flow passage, the tree cap having a production flow outlet leading from its production flow passage and in fluid communication with the production flow outlet of the spool;

an isolation tube on a lower end of the tree cap that extends into the bore of the wellhead housing and sealingly engages the production flow passage of the tubing hanger; and at least one valve mounted to an exterior portion of the spool for controlling flow from the well through the production flow passage of the tubing hanger, the production flow passage and production outlet of the insert and the production outlet of the spool.

7. The assembly according to claim 6, further comprising a valve in the production flow passage of the tree cap.

8. The assembly according to claim 6, wherein the tree cap has a mandrel that protrudes above the spool and has an external grooved profile for attaching workover pressure control equipment to the tree cap.

9. The assembly according to claim 6, further comprising a tubing annulus passage extending through a side wall of the spool below the production flow outlet, above the tubing hanger, and in fluid communication with the bore of the wellhead housing above the tubing hanger for communicating with the tubing annulus below the tubing hanger.

10. The assembly according to claim 9, further comprising:

a tubing annulus valve in the tubing annulus port in the tubing hanger, the tubing annulus valve being spring-biased toward a closed position; and an actuator on a lower end of the tree cap for engaging and opening the tubing annulus valve as the tree cap sealingly engages the production passage in the tubing hanger.

11. The assembly according to claim 6, the tree cap has an integral flange that lands on a rim of the spool as the tree cap is inserted into the bore of the spool.

12. The assembly according to claim 6, further comprising an external connector on the tree cap for connecting the tree cap to an external profile on the spool.

13. The assembly according to claim 6, wherein the upper seal comprises an uppermost pressure barrier in the spool.

14. The assembly according to claim 6, wherein the bore of the spool is at least equal to a diameter of the casing hanger so as to allow the casing hanger to be installed through the spool.

15. The assembly according to claim 6, further comprising:

an auxiliary line passage extending through the tubing hanger for connection to an auxiliary line extending alongside the tubing;

an auxiliary line passage within the tree cap that registers with the auxiliary line passage in the tubing hanger and leads to an exterior area of the tree cap above the spool; and a control module mounted to the tree cap and coupled to the auxiliary line passage within the tree cap for controlling a downhole function through the auxiliary line.

16. A method of completing a subsea well, comprising:

(a) landing a tubing hanger connected to a string of tubing in a subsea wellhead housing, the wellhead housing supporting a casing hanger secured to a string of production casing extending into the well;

(b) providing a spool with a bore, a flow outlet leading laterally from the bore, and a valve mounted to an exterior of the spool at the lateral flow outlet;

(c) providing a tree cap with a production flow passage, a flow outlet leading laterally from the bore, and an isolation tube extending below the tree cap;

(d) installing the tree cap in the bore of the spool with the flow outlet of the tree cap in communication with the flow outlet of the tree and sealing the tree cap to the bore of the spool above and below the flow outlet of the tree; then (e) lowering the spool and the tree cap as an assembly onto the wellhead housing, engaging the isolation tube with the production flow passage of the tubing hanger, and connecting the spool to the wellhead housing; and (f) flowing well fluid up the tubing, through the production flow passage of the tubing hanger and out the production flow outlets of the tree cap and the spool.

17. The method according to claim 16, wherein step (c) comprises installing a valve in the production flow passage of the tree cap, and wherein the method further comprises:

after step (a) and before step (e), perforating the well and installing a plug within the production flow passage of the tubing hanger; and after step (e) and before step (f), opening the valve in the tree cap and retrieving the plug, then closing the valve in the tree cap before step (f).

18. The method according to claim 16, further comprising performing a workover operation on the well, comprising:

installing a plug in the production passage of the tubing hanger;

retrieving the tree cap;

connecting a riser to the spool; and retrieving the tubing hanger and the tubing through the riser.

19. The method according to claim 18, further comprising after retrieving the tubing hanger and the tubing:

retrieving the casing hanger and the production casing through the spool and the riser; then lowering a drill string through the spool and the riser and drilling a sidetrack portion of the well; then installing casing and tubing in the sidetrack portion of the well.

20. The method according to claim 16, further comprising:

providing the tubing hanger with a tubing annulus passage and a tubing annulus valve therein that is spring-biased to a closed position;

installing an actuator on a lower end of the tree cap; and step (e) further comprises opening the tubing annulus valve by engaging the actuator of the tree cap with the tubing annulus valve.

* * * * *